US009278573B2

(12) United States Patent
Bregier

(10) Patent No.: US 9,278,573 B2
(45) Date of Patent: Mar. 8, 2016

(54) METHOD FOR ORNAMENTALLY DECORATING AN INANIMATE OBJECT

(71) Applicant: Mona Charlene Bregier, Charlotte, NC (US)

(72) Inventor: Mona Charlene Bregier, Charlotte, NC (US)

( * ) Notice: Subject to any disclaimer, the term of this patent is extended or adjusted under 35 U.S.C. 154(b) by 335 days.

(21) Appl. No.: 13/861,592

(22) Filed: Apr. 12, 2013

(65) Prior Publication Data

US 2014/0305585 A1 Oct. 16, 2014

(51) Int. Cl.

| | |
|---|---|
| ***B44C 1/10*** | (2006.01) |
| ***B44C 1/28*** | (2006.01) |
| ***B44C 5/06*** | (2006.01) |

(52) U.S. Cl.

CPC ... *B44C 1/28* (2013.01); *B44C 1/10* (2013.01); *B44C 5/06* (2013.01); *Y10T 156/10* (2015.01)

(58) Field of Classification Search

CPC ..... B44C 1/28; B44C 1/105

See application file for complete search history.

(56) References Cited

U.S. PATENT DOCUMENTS

| | | | | |
|---|---|---|---|---|
| 116,375 | A | 6/1871 | Vining et al. | |
| 996,788 | A | 7/1911 | Ostrander | |
| 1,779,299 | A | 10/1930 | Valentine | |
| 3,865,569 | A | 2/1975 | Parups et al. | |
| 3,929,448 | A | 12/1975 | Brantley | |
| 4,061,490 | A | 12/1977 | Yukinaga et al. | |
| 4,272,571 | A | 6/1981 | Romero-Sierra et al. | |
| 4,783,342 | A | 11/1988 | Polovina | |
| 5,580,840 | A | 12/1996 | Harms et al. | |
| 6,265,346 | B1 | 7/2001 | Reeves et al. | |
| 6,395,114 | B1 * | 5/2002 | Benado | 156/61 |
| 6,417,119 | B1 * | 7/2002 | Roberson | 442/149 |

FOREIGN PATENT DOCUMENTS

| | | | |
|---|---|---|---|
| EP | 342248 | A1 * | 11/1989 |
| JP | 59-044301 | | 3/1984 |

* cited by examiner

*Primary Examiner* — Daniel Lee

(74) *Attorney, Agent, or Firm* — Hammer & Associates, P.C.

(57) ABSTRACT

A method for covering an inanimate object with a botanical article includes the following steps: taking a dried botanical article having at least one surface, applying an adhesive to the surface of the botanical article, affixing the botanical item to the inanimate object by applying the surface covered with the adhesive to the inanimate object, whereby a natural veining and coloring of the botanical article are preserved, and optionally, applying a sealant over the botanical articles covering the inanimate object. The inanimate object may include sculptures, vessels, carvings, and frames. The botanical article may include flower petals, leaves, skeleton leaves, plant skins, and combinations thereof.

17 Claims, 2 Drawing Sheets

METHOD FOR ORNAMENTALLY DECORATING AN INANIMATE OBJECT

FIELD OF THE INVENTION

The invention is directed to a method of ornamentally decorating the surface of an inanimate object, e.g., a sculpture, with botanical articles, e.g., flower petals.

BACKGROUND OF THE INVENTION

In the artistic world, there is a striving to adorn inanimate objects with unique surfaces to enhance their aesthetic appeal.

U.S. Pat. No. 116,375 teaches a method of preserving flower petals by drying the flowers in an acid treated gravel and strengthening the dried petals with a coating of wax.

U.S. Pat. No. 996,788 teaches a method of preserving flowers by immersing fresh flowers in a mixture of flake glue, sugar, Epsom salt, and tartaric acid. Thereafter, the flower may be dipped into a coloring solution of alcohol and dye. Then, if desired, the flowers may be colored with a brush. Finally, a coating of varnish may be applied.

U.S. Pat. No. 1,779,299 teaches a method of preserving flowers by applying a waxy coating, then a binding coating, and finally a colloidal coating.

U.S. Pat. No. 3,865,569 teaches that flowers may be preserved with a formulation of sucrose, isoascorbic or ascorbic acid (or salts thereof), and 8-hydroxyquinoline (or sulphates or salts thereof).

U.S. Pat. No. 3,929,448 teaches that flowers may be preserved by contacting with an aqueous solution containing a carbamoylphosphonate compound.

U.S. Pat. No. 4,061,490 teaches that flowers may be preserved with a composition having an active ingredient of a naphthoquinone derivative.

U.S. Pat. No. 4,272,571 teaches a method of preserving a flower by immersing in an essentially water-free composition of a dehydrating alcohol, a carboxylic acid, a urea-containing compound, an alkaline citrate, and an optional dehydrating agent.

JP59-044301 teaches that flowers may be preserved with a solution of adhesive and a fade-preventing agent (alum).

U.S. Pat. No. 4,783,342 teaches that plants may be preserved during a drought (or it can be used to preserve cut flowers) by applying a solid water permeable film which controls water loss to the surface of the plants.

U.S. Pat. No. 5,580,840 teaches preserving flowers with a water-soluble solution of a polyamino organic acid.

U.S. Pat. No. 6,265,346 teaches a method of preserving flowers by coating the flower with beeswax and then applying a sealant of natural lacquer over the beeswax.

U.S. Pat. No. 6,395,114 teaches a method creating from a plant by coating, with at least one layer, the plant with a composition consisting of: an adhesive, a latex emulsion, and a thickener. The plant is encased and preserved under the hardened composition. This botanical sculpture consists of a plant plastered with a viscous paste composition. The plant is the armature (frame or skeleton upon which the sculpture is built). It is noted that the latex emulsion alone is not sufficient to accomplish the '114 invention because with the use of the latex emulsion alone, the plant will not hold its shape. There is no mention of affixing the plant to an inanimate object.

Most of the foregoing are directed to preserving flowers and are not directed to the invention discussed below which is a method for decorating an inanimate object with a botanical article.

It is known to cover mannequins with newspaper. These mannequins, however, do not have the esthetic quality required in the invention discussed below.

There is a need for a method for covering an inanimate object with a botanical article where the natural veining and color of the botanical article are preserved and the exterior appearance of the inanimate object is enhanced.

SUMMARY OF THE INVENTION

A method for covering an inanimate object with a botanical article includes the following steps: taking a dried botanical article having at least one surface, applying an adhesive to the surface of the botanical article, affixing the botanical item to the inanimate object by applying the surface covered with the adhesive to the inanimate object, whereby a natural veining and coloring of the botanical article are preserved, and optionally applying a sealant over the botanical articles covering the inanimate object. The inanimate object may include sculptures, vessels, carvings, and frames. The botanical article may include flower petals, leaves, skeleton leaves, plant skins, and combinations thereof.

DESCRIPTION OF THE DRAWINGS

For the purpose of illustrating the invention, there is shown in the drawings a form that is presently preferred; it being understood, however, that this invention is not limited to the precise arrangements and instrumentalities shown.

DESCRIPTION OF THE INVENTION

Figures 1, 1A:
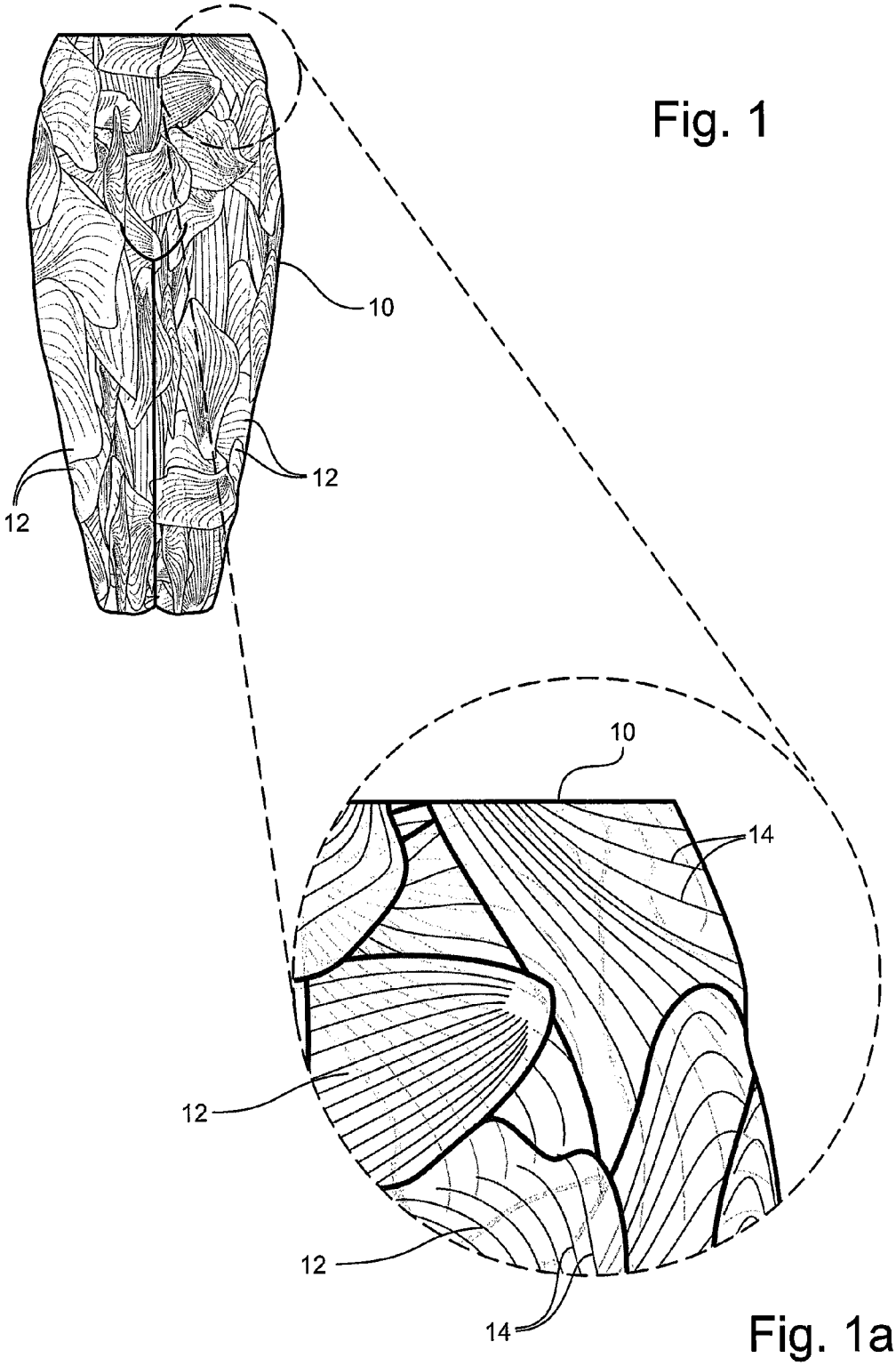
FIG. 1 shows a sculpture covered with botanical articles according to the present invention with a portion magnified (FIG. 1*a*) to illustrate the natural veining preserved.

Referring to the figures, where like numerals indicate like elements, there is shown in FIG. 1 an inanimate object 10 made according to the present invention. Inanimate object 10 is covered with a layer of botanical articles 12. In one embodiment, the layer of botanical articles may have a matte finish. In another embodiment, the layer of botanical articles may have a glossy finish. The magnified portion of FIG. 1*a* illustrates the natural veining 14 of the botanical article 12.

The instant invention does not encased any botanical articles in any composition like that taught in U.S. Pat. No. 6,395,114, but instead the botanical articles are affixed to an inanimate article with an adhesive. In U.S. Pat. No. 6,395,114, the botanicals may be affixed various ornamental articles after encasement, but in the instant invention, the botanical articles are affixed to the inanimate article without encasement prior to being affixed to the inanimate article. The botanical article is not an armature as in U.S. Pat. No. 6,395,114, but instead the inanimate object is the armature. Further, the product produced in U.S. Pat. No. 6,395,114 will have a hard shell or porcelain-type finish, where the instant invention the instant invention serves to augment the intrinsic beauty of the sculpture or other inanimate object rather than preserving the natural appearance of the botanical.

Inanimate object 10 may be any inanimate object. The inanimate object may include, for example, sculptures, vessels, carvings, and frames. The inanimate object may be made of any material. Such materials may include, for example, air dried clay, fired clay, water based clay, any stone (including soapstone), wood, plaster, cement, styrofoam, and plastics. The inanimate object may have any shape, for example, a human form (whole or part), an animal form (whole or part), objects in nature, abstract shapes, geometric shapes, and the like.

Botanical article 12 may be any botanical article. The botanical article is one produce in nature and is not man-made. The botanical article may include, for example, flower petals, leaves, skeleton leaves, plant skins, and combinations thereof. The botanical article also refers to individual petals, leaves, or skin separated from the rest of the plant. Before use, the botanical articles may be altered to modify their appearance by boiling, refining, or the like. Skeleton leaf refers to the veins of a leaf after the fleshy pulp have been eaten or washed away. The botanical articles do not include any newspaper or other printed article or printed matter or photograph or sketch on paper.

In general, the method includes the following steps: 1) taking a dried botanical article having at least one surface, 2) applying an adhesive to the surface of the botanical article, and 3) affixing the botanical item to the inanimate object by applying the surface covered with the adhesive to the inanimate object, so that the natural veining and coloring of the botanical article is preserved. Optionally, the method may include 4) applying a sealant over the botanical articles covering the inanimate object.

The dried botanical article may be obtained in any manner. Three methods for obtaining the dried botanical articles are mentioned herein.

First, dried botanical articles may be obtained by an oven method. In one embodiment, the oven method uses a microwave oven, where a layer of desiccating material is spread over the surface of a microwave safe vessel, then the botanical article is placed on the desiccating material, and then another layer desiccating material is spread over the botanical articles. The thus prepared vessel is then inserted into the microwave oven, set at 50% power, and powered on for about 3 minutes. After the time is up, the vessel is allowed to cool, and then the botanical articles are removed, and straightened, as necessary. The desiccating material may be any desiccating material. In one embodiment, the desiccating material may be a silica gel (for example, POUR ACTIVA flower Drying Art available from activaproducts.com.

Second, dried botanical articles may be prepared by air (ambient atmosphere) drying method. The botanical articles are arranged in a closed container, or between the sheets of newspaper, wax paper, or paper towels and allowed to dry for several weeks, e.g., about two weeks.

Third, dried botanical articles may be purchased.

The adhesive is then applied to one surface of the dried botanical article. The adhesive may be applied in any manner. In one embodiment, the adhesive is applied with a brush, but it may also be sprayed onto the botanical article. In one embodiment, the amount of adhesive applied should be sufficient to ensure that the botanical article adheres to the inanimate article, but not so much as to obscure the natural veining and color of the botanical article.

The adhesive may be any adhesive. For example, the adhesive may be an emulsion based (polymer dispersion) adhesive and/or a solvent based adhesive. In one embodiment, the adhesive is a liquid and is not a paste as described in U.S. Pat. No. 6,395,114. In one embodiment, the adhesive consists of a latex emulsion. The latex emulsion may be any latex emulsion. The latex emulsion may be prepared by any known methods of emulsion polymerization. Emulsions containing homo and copolymers of vinyl esters, acrylate and methacrylate esters, maleic acid, maleic anhydride, and maleic acid esters may be effective. Such emulsions, for example, may include vinyl acetate homopolymers and copolymers of the same with ethyl and butyl acrylates and methacrylates as well as dibutyl maleate. In one embodiment, the emulsion comprises about 92.5 percent by weight of an approximately 55 percent nonvolatile poly vinyl acetate (PVA) aqueous latex including conventional stabilizers with about 7.5 percent dibutyl phthlate or other conventional plasticizers. Often the latex emulsion is plasticized polyvinyl acetate latex emulsion prepared by emulsion polymerization. An exemplary latex emulsion is MOD PODGE®, Matte or Glossy, and preferably Matte, available from Plaid Enterprises of Norcross, Ga.

Figure 2:
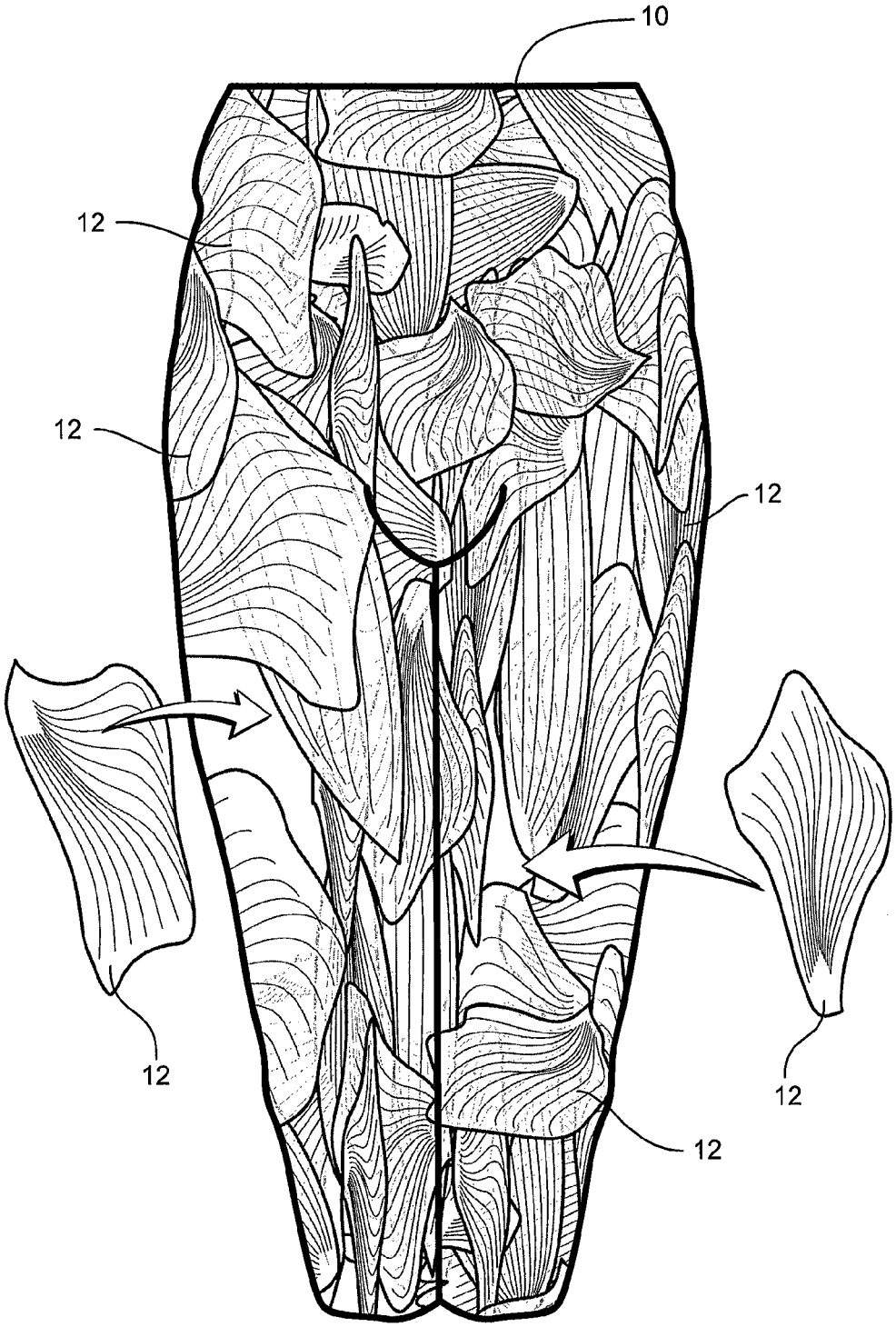
FIG. 2 shows the sculpture partially covered with the botanical articles.

The botanical article, with the side having the adhesive facing the inanimate object, is affixed to the inanimate object. FIG. 2 shows inanimate object 10 partially covered with botanical articles 12. In one embodiment, the botanical articles are applied to the inanimate object in a single layer. In another embodiment, the botanical articles have some overlap of the peripheral edges of other botanical articles. In yet another embodiment, the botanical articles cover all or part of the inanimate article. The botanical articles may be arranged in any order or pattern. The botanical articles may be the same or different (e.g., petals and leaves).

After affixing of the botanical articles to the inanimate object, the article is allowed to dry. Drying may be completed in minutes, for example 20-30 minutes.

Optionally, after drying, a sealant may be applied to the botanical articles affixed on the inanimate object. The sealant may be any commercially available sealant. The sealant may be a water-insoluble sealer. In one embodiment, the sealant may be an acrylic or enamel based sealer. An example of such a sealer is DMP available from Gard Products of Carpentersville, Ill.

The present invention may be embodied in other forms without departing from the spirit and the essential attributes thereof, and, accordingly, reference should be made to the appended claims, rather than to the foregoing specification, as indicating the scope of the invention.

I claim:

1. A method for covering an inanimate object with a botanical article consisting of the steps:

taking a dried botanical article having at least one surface, applying an adhesive to the surface of the botanical article, affixing the botanical article to the inanimate object by applying the surface covered with the adhesive to the inanimate object, and applying a non-water soluble sealant over the botanical article covering the inanimate object, wherein the non-water soluble sealant comprises an acrylic sealant or an enamel sealant or a combination of both, whereby a natural veining and coloring of the botanical article are preserved.

2. The method of claim 1 wherein the adhesive is a liquid and not a paste.

3. The method of claim 1 wherein the adhesive consists of a latex emulsion.

4. The method of claim 3 wherein the latex emulsion comprises polyvinyl acetate (PVA).

5. The method of claim 1 wherein the dried botanical article are obtained by the step of:

drying the botanical article in the presence of a desiccating material.

6. The method of claim 5 wherein drying further comprises drying in an oven.

7. The method of claim 6 wherein the oven comprises a microwave oven.

8. The method of claim 5 wherein the desiccating material comprises a silica gel.

9. The method of claim 1 wherein the dried botanical article are obtained by the step of:

drying the botanical article in an ambient atmosphere.

10. The method of claim 1 wherein affixing further comprises the steps of:

overlapping peripheral edges of the botanical article in a single layer on the inanimate object.

11. The method of claim 1 wherein affixing further comprises the step of:

drying the affixed botanical article to the inanimate object.

12. The method of claim 1 wherein the inanimate object is selected from the group consisting of: sculptures, vessels, carvings, and frames.

13. The method of claim 1 wherein the botanical article is selected from the group consisting of: flower petals, leaves, skeleton leaves, plant skins, and combinations thereof.

14. A method for covering an inanimate object with a botanical article comprising the steps of:

taking a dried botanical article having at least one surface, applying an adhesive to the surface of the botanical article, and affixing the botanical article to the inanimate object by applying the surface covered with the adhesive to the inanimate object, wherein the inanimate object is selected from the group consisting of: sculptures, vessels, carvings, and frames, and applying a non-water soluble sealant over the botanical article covering the inanimate object, wherein the non-water soluble sealant comprises an acrylic sealant or an enamel sealant or a combination of both, whereby a natural veining and coloring of the botanical article are preserved.

15. The method of claim 14 wherein the adhesive consists of a latex emulsion.

16. The method of claim 15 wherein the latex emulsion comprises polyvinyl acetate (PVA).

17. The method of claim 14 wherein affixing further comprises the steps of:

overlapping peripheral edges of the botanical article in a single layer on the inanimate object.

* * * * *